US009455543B2

(12) United States Patent
Liao

(10) Patent No.: US 9,455,543 B2
(45) Date of Patent: Sep. 27, 2016

(54) WALL SOCKET HAVING CONNECTING MODULE AND WALL SWITCH HAVING CONNECTING MODULE

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 208 days.

(21) Appl. No.: 14/249,415

(22) Filed: Apr. 10, 2014

(65) Prior Publication Data

US 2015/0263447 A1 Sep. 17, 2015

(30) Foreign Application Priority Data

Mar. 14, 2014 (TW) ..... 103109433 A

(51) Int. Cl.

| | |
|---|---|
| ***H01R 13/44*** | (2006.01) |
| ***H01R 31/06*** | (2006.01) |
| ***H01R 27/02*** | (2006.01) |
| *H01R 13/73* | (2006.01) |
| *H01R 13/70* | (2006.01) |
| *H01R 24/76* | (2011.01) |

(52) U.S. Cl.

CPC ..... *H01R 31/065* (2013.01); *H01R 27/02* (2013.01); *H01R 13/70* (2013.01); *H01R 13/73* (2013.01); *H01R 24/76* (2013.01)

(58) Field of Classification Search

CPC ..... H01R 13/70; H01R 27/02; H01R 31/65
USPC ..... 439/701, 373, 372, 113, 131, 652, 535, 439/134–136, 142, 521, 528, 892, 893; 174/48, 49

See application file for complete search history.

(56) References Cited

U.S. PATENT DOCUMENTS

| | | | | |
|---|---|---|---|---|
| 6,290,518 | B1 * | 9/2001 | Byrne | H02G 3/185 16/224 |
| 7,364,443 | B1 * | 4/2008 | McGinnis | H01R 35/02 439/131 |
| 7,738,247 | B2 * | 6/2010 | Choi | H02J 7/0044 361/679.43 |
| 7,887,341 | B2 * | 2/2011 | Liao | H01R 13/60 439/131 |
| 7,887,362 | B2 * | 2/2011 | Liao | H02J 7/0044 439/501 |
| 8,221,158 | B2 * | 7/2012 | Liao | H01R 13/60 439/535 |
| 8,545,260 | B2 * | 10/2013 | Zhou | H01R 13/72 191/12.4 |
| 8,801,441 | B2 * | 8/2014 | Zhang | H01R 13/633 439/131 |
| 8,986,022 | B2 * | 3/2015 | Dinh | H01R 13/5213 439/131 |
| 2005/0130467 | A1 * | 6/2005 | Sharples | H01R 13/44 439/131 |
| 2006/0073725 | A1 * | 4/2006 | Liao | H01R 27/02 439/304 |
| 2009/0191735 | A1 * | 7/2009 | Lin | H01R 13/72 439/131 |
| 2010/0315036 | A1 * | 12/2010 | Liao | H02J 7/0042 320/107 |
| 2012/0069518 | A1 * | 3/2012 | Hsu | H05K 5/0278 361/679.58 |
| 2015/0104966 | A1 * | 4/2015 | Logvinov | H01R 31/06 439/345 |

* cited by examiner

*Primary Examiner* — Amy Cohen Johnson
*Assistant Examiner* — Milagros Jeancharles
(74) *Attorney, Agent, or Firm* — Li & Cai Intellectual Property (USA) Office

(57) ABSTRACT

A wall socket having a connecting module includes a socket body and a connecting module. The socket body has a socket unit. The connecting module is mounted with the socket unit. The connecting module is electrically connected with the socket body and selectively protruded outside the socket body. Therefore, the invention has functions of wall socket, electricity-transmitting and electricity-connection, which is convenient for various applications with a better universal characteristic.

14 Claims, 17 Drawing Sheets

WALL SOCKET HAVING CONNECTING MODULE AND WALL SWITCH HAVING CONNECTING MODULE

BACKGROUND OF THE INVENTION

1. Field of the Invention

The present disclosure relates to a wall electronic apparatus; in particular, to a wall socket having a connecting module and a wall switch having a connecting module.

2. Description of Related Art

Most wiring for indoor supply of electricity are laid inside walls and accessed to via sockets distributed on the walls. When an electronic device (e.g. cell phone, digital camera, PDA and other portable electronic devices) needs to be charged or connected to the internet, the user can plug the electronic device to the socket via cables and plugs, such that the electronic device is connected to the power supply or signal network for respectively obtaining power or connecting to the internet. However, conventional wall sockets have limited functions and cannot provide the functions of an adapter. When the user needs to use an adapter, one must be purchased separately, creating inconvenience. A conventional wall switch is also a conventional wall electronic apparatus which likewise cannot provide the functions of an adapter, presenting the same problems as mentioned above.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a wall socket having a connecting module and a wall switch having a connecting module, such that wall electronic apparatus serve as adapters and connectors, for providing a more universal function and varied application, and also reducing the need of the buyer to purchase adapters.

In order to achieve the aforementioned objects, the present disclosure provides a wall socket having a connecting module comprising: a socket body having a socket unit; and a connecting module disposed on and electrically connected the socket body, wherein the connecting module selectively protrudes from the socket body.

In order to achieve the aforementioned objects, the present disclosure provides a wall switch comprising: a switch body having a switch unit; and a connecting module disposed on and electrically connected to the switch body, wherein the connecting module selectively protrudes from the switch body.

The present disclosure has the following advantages: the wall socket of the present disclosure includes a socket body and a connecting module, serving as a socket, adapter and connector, providing a more universal function and varied application, and also reducing the need of the buyer to purchase adapters.

Moreover, the connecting module can be arranged at the top of the socket body such that electronic devices can be plugged on top of the socket body, such that the socket body also has the function of bearing electronic devices. When an electronic device is being charged, connected to the power supply or connected to the internet, the electronic device can be stably placed.

The wall switch of the present disclosure serves as a switch, adapter and connector. Electronic devices can also be placed on top of the switch body, such that the switch body has the function of bearing electronic devices.

In order to further the understanding regarding the present disclosure, the following embodiments are provided along with illustrations to facilitate the disclosure of the present disclosure.

DETAILED DESCRIPTION OF THE PREFERRED EMBODIMENTS

First Embodiment

Figure 1:
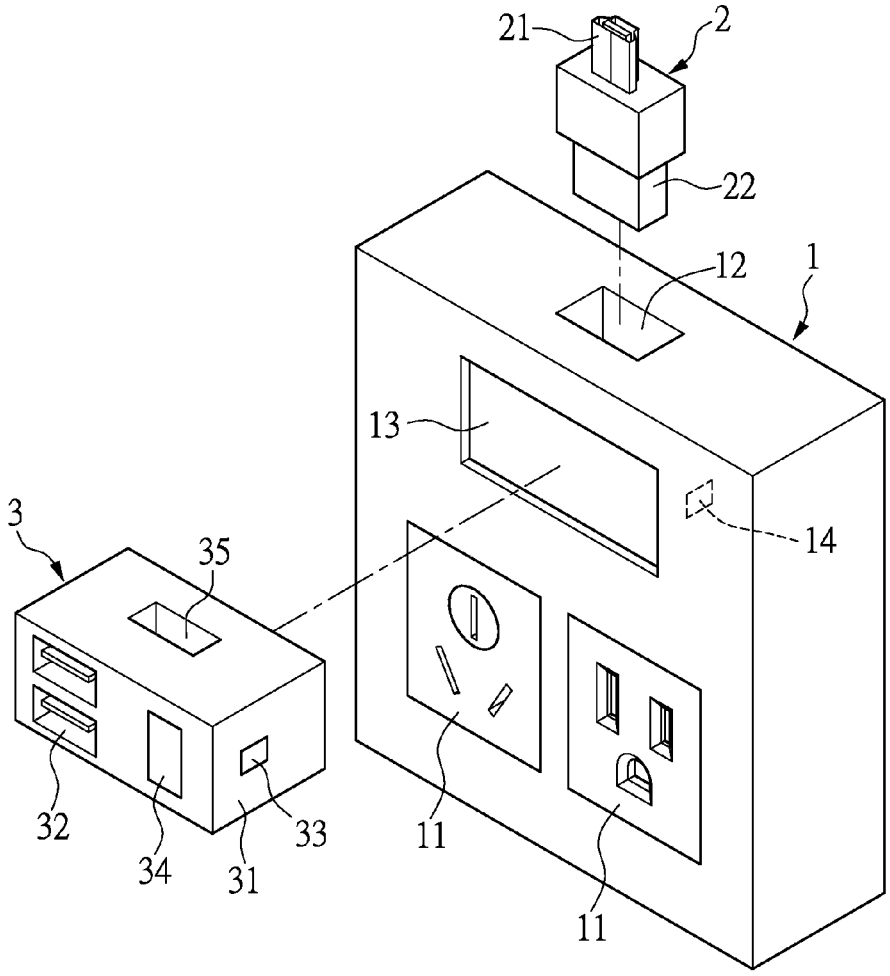
FIG. 1 shows an exploded view of a wall socket according to a first embodiment of the present disclosure.
Figure 2:
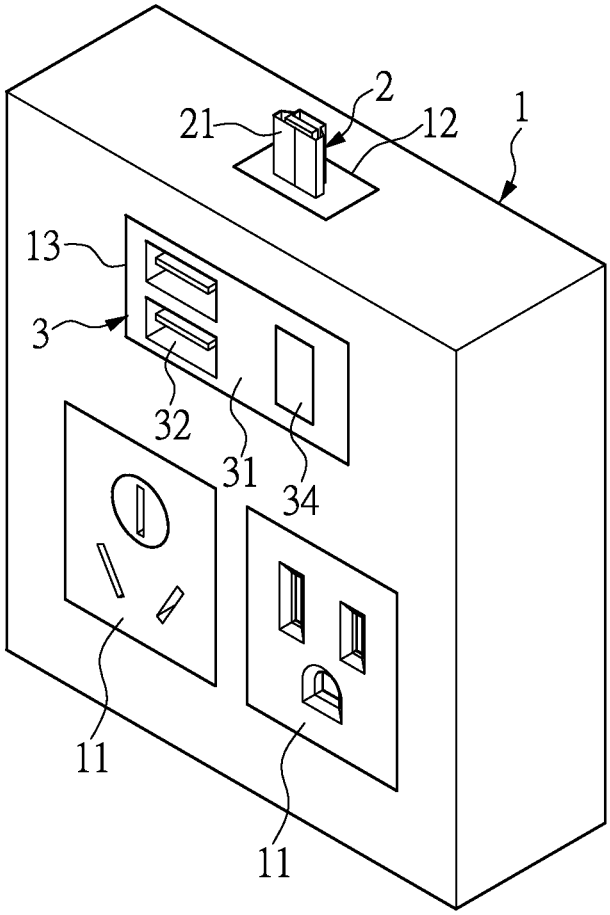
FIG. 2 shows a perspective view of a wall socket according to a first embodiment of the present disclosure.

Referring to FIG. 1 and FIG. 2, the present disclosure provides a wall socket having a connecting module, comprising a socket body 1 and a connecting module 2. The shape of the socket body 1 is not limited, and can be board-shaped, block-shaped or other shapes according to need. The socket body 1 can be integrally formed as one piece, or assembled from two or more pieces. The socket body 1 has at least one socket unit 11. The specification of the socket 11 is not limited. The socket unit 11 can be a socket or electrical connector of different types. A circuit can be disposed inside the socket body 1 (omitted in the figures). Since the socket body 1 and the socket unit 11 are similar to conventional techniques, and the present disclosure does not limit the type and structure of the socket body 1 nor those of the socket unit 11, the socket body 1 and the socket unit 11 are not further detailed herein.

The connecting module 2 is disposed on the socket body 1. The connecting module 2 can be electrically connected to the socket body 1 and a replaceable module 3. The connecting module 2 can be selectively protruding from the socket body 1. The specification and structure of the connecting module 2 is not limited, and can be a USB connector, IEEE1394 connector, HAMI connector, AV terminal, DC terminal, etc. The connecting module 2 can be plugged into or pivoted about the socket body 1. The connecting module 2 can be an input terminal or an output terminal. In the present embodiment, the connecting module 2 is inserted in the socket body 1. Namely, a docking slot 12 can be formed at the edge of the socket body 1. The docking slot 12 can be positioned at the top, left side, or right side of the socket body 1. Additionally, the connecting module 2 can have a first connector 21 and a second connector 22. The specification of the first connector 21 and the specification of the second connector 22 are different. The first connector 21 and the second connector 22 are electrically connected. The connecting module 2 can be plugged to the docking slot 12 such that the connecting module 2 is fixed on the socket body 1. The connecting module 2 can be electrically connected to the socket body and the replaceable module 3 through the second connector 22. The first connector 21 of the connecting module 2 can protrude from an edge of the socket body 1 (e.g. the top edge) for plugging into an electronic device.

Referring to FIG. 1 and FIG. 2, in the present embodiment, the wall socket further comprises a replaceable module 3 removably disposed on the socket body 1. The amount of replaceable module 3 can be 1, and can be two or more according to need. The present disclosure discloses one replaceable module 3. The replaceable module 3 has a module body 31 and at least one connector unit 32 disposed on the module body 31. The module body 31 can be square or of other shapes, and is not limited thereto. The connector unit 32 can be a USB connector, IEEE 1394 connector, HDMI connector, AV terminal, DC terminal, etc. A face of the socket body 1 (e.g. the front face) can be formed with an accommodating slot 13 corresponding to the replaceable module 3. The replaceable module 3 is removably (selectively) accommodated in the accommodating slot 13. The replaceable module 3 can be fixed to the socket body 1 by screw or other methods. The connector unit 32 is exposed on the socket body 1.

One, two or more electrical contacts 33 can be disposed at the periphery of the replaceable module 3, for contacting respective electrical contacts 14 on the socket body 1 to achieve electrical connection. The electrical contacts 14 of the socket body 1 can be electrically connected to the circuit of the socket body 1, such that the replaceable module 3 and the circuit insides the socket body 1 can be electrically connected, and the electricity or signal of the socket body 1 can be transmitted to the replaceable module 3. The replaceable module 3 and the connector unit 32 can act as an input terminal or an output terminal.

In the present embodiment, the accommodating slot 13 is formed at one face of the socket body 1 (the front face), such that the replaceable module 3 is exposed on one face of the socket body 1. In another embodiment (not shown in the figures), multiple replaceable modules 3 can be disposed on the socket body 1. The thickness of the socket body 1 is greater, and some of the accommodating slot 13 is formed at the side of the socket body 1 such that some of the replaceable modules 3 are exposed at the side of the socket body 1.

The replaceable module 3 is disposed on the socket body 1, and the front end of the replaceable module 3 can slightly protrude from the front face of the socket body 1, or be aligned with the front face of the socket body 1. The sides of the replaceable module 3 can be formed with indentations or protrusions (omitted in the figures), for facilitating the removal of the replaceable module 3 from the accommodating slot 13 by using tools, rendering the replacing of the replaceable module 3 more convenient.

The module body 31 can have an electronic apparatus 34. The electronic apparatus 34 can be hidden in or exposed at the module body 31. The electronic apparatus 34 can be a transformer, a night light, a wireless charger, an emergency lighting, a wireless controller, a wireless AP, a wireless module, a timer, a ground fault circuit interrupter (GFCI), a line reeling device, a sensor, etc. The electronic apparatus 34 can also be a motion detector, capable detecting moving objects. The electronic apparatus 34 can also be batteries, such that the replaceable module 3 can be a portable battery.

A side of the replaceable module 3 can be formed with a connecting seat 35 corresponding to the docking slot 12. The connecting seat 35 can be a USB connector, IEEE1394 connector, HDMI connector, AV terminal, DEC terminal, etc. The connecting seat 35 is formed on the face of the replaceable module 3 facing the docking slot 12, such that when the connecting module 2 is plugged in the docking slot 12, the second connector 22 of the connecting module 2 can be plugged in the connecting seat 35, electrically connecting the connecting module 2 to the replaceable module 3 through the second connector 22 and the connecting seat 35. The plugging of the connecting module 2 into both the docking slot 12 and the connecting seat 35 provides fixture and more secure fastening, such that the connecting module 2 and the replaceable module 3 can be stably disposed on the socket body 1.

Figure 3:
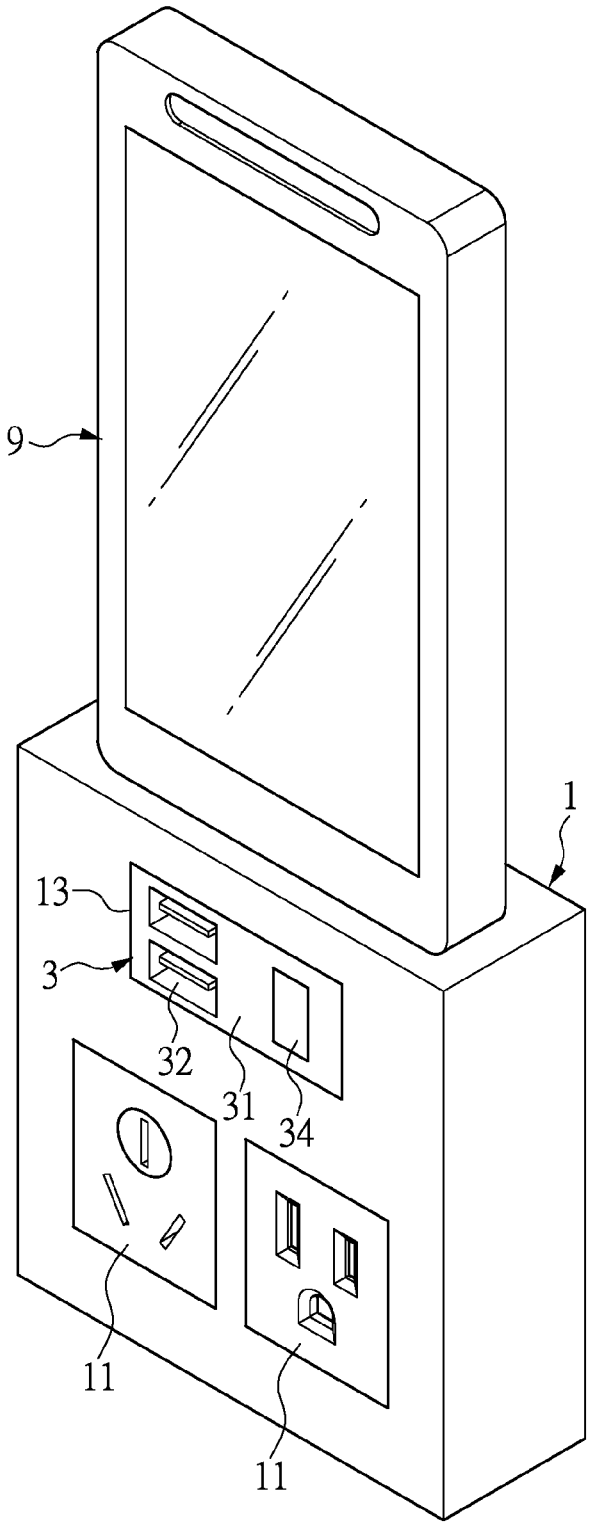
FIG. 3 shows a perspective of a wall socket in use according to a first embodiment of the present disclosure.

Referring to FIG. 2 and FIG. 3, during use, the user can plug an electronic device 9 (e.g. cell phone) into the first connector 21 of the connecting module 2 such that the electronic device 9 and the wall socket are electrically connected. The electronic device 9 can be electrically connected, charged, and connected to the internet. Moreover, the electronic device 9 can be disposed on top of the socket body 1, such that the electronic device 9 is stably placed. Additionally, the electronic device 9 can be electrically connected to the connector unit 32 or the socket unit 11 through cables (omitted in the figures) such that the electronic device can be electrically connected, charged, and connected to the internet.

Second Embodiment

Figure 4:
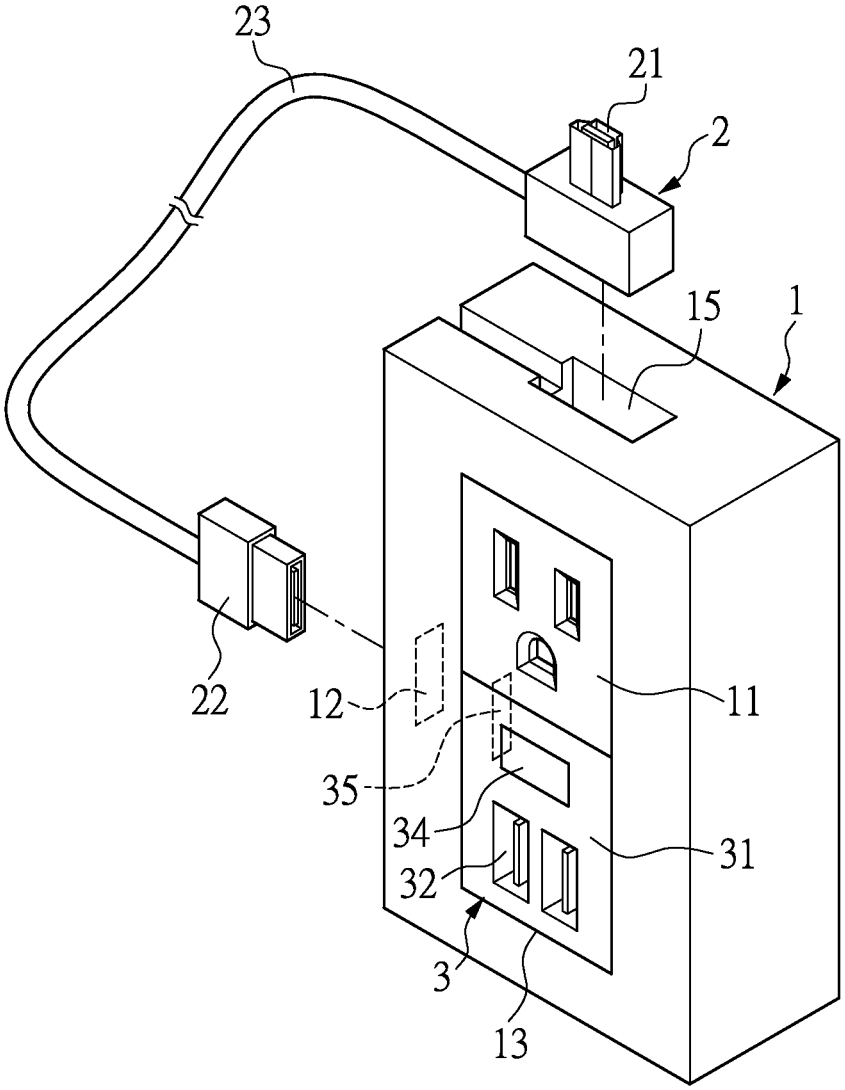
FIG. 4 shows a perspective view of a wall socket according to a second embodiment of the present disclosure.

Referring to FIG. 4, in the present embodiment, the structure and specification of the socket body 1 and the replaceable module 3 are modified, and the docking slot 12 is positioned at a side of the socket body 1. The connecting module 2 is disposed on the socket body 1. The connecting module 2 has a first connector 21 and a second connector 22. The first connector 21 and the second connector 22 are electrically connected by a cable 23. The connecting seat 35 is disposed at the face of the replaceable module 3 facing the docking slot 12, such that when the second connector 22 of the connecting module 2 is plugged in the docking slot 12, the second connector 22 of the connecting module 2 can be plugged in the connecting seat 35 at the same time, electrically connecting the connecting module 2 to the replaceable module 3 through the second connector 22 and the connecting seat 35. The first connector 21 of the connecting module 2 is disposed in a groove 15 formed on a side (e.g. the top side) of the socket body 1. The first connector 21 selectively protrudes from the side of the socket body 1 for plugging to electronic devices.

Third Embodiment

Figure 5:
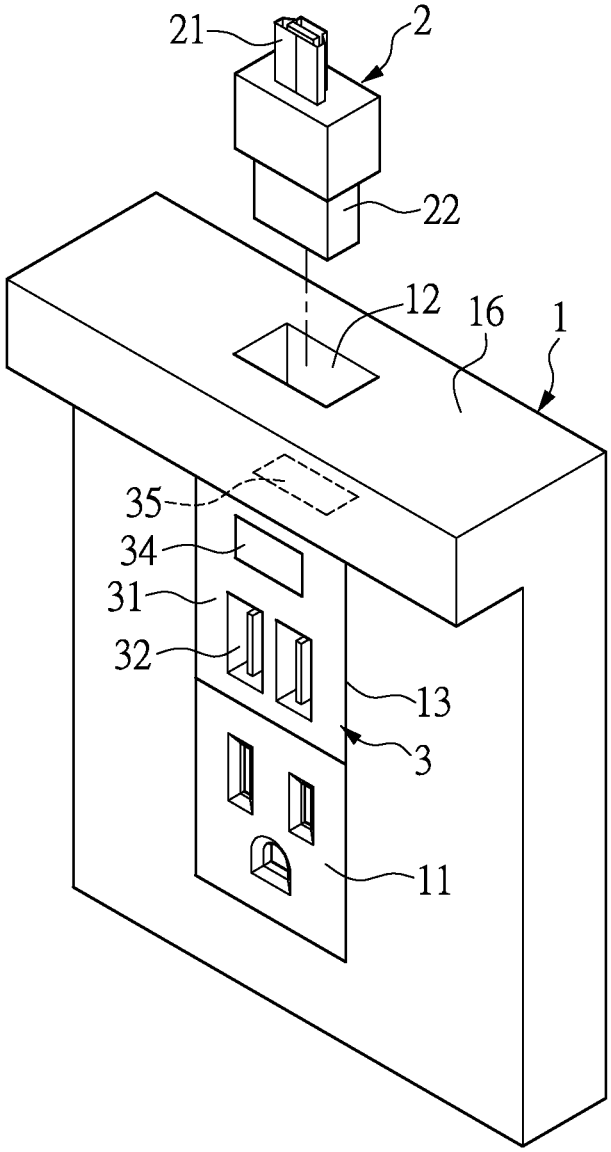
FIG. 5 shows a perspective view of a wall socket according to a third embodiment of the present disclosure.

Referring to FIG. 5, in the present embodiment, the docking slot 12 is positioned at the top side of the socket body 1, the connecting seat 35 is disposed the face of the replaceable module 3 facing the docking slot 12, such that when the second connector 22 of the connecting module 2 is plugged in the docking slot 12, the second connector 22 of the connecting module 2 can be plugged in the connecting seat 35 at the same time, electrically connecting the connecting module 2 to the replaceable module 3 through the second connector 22 and the connecting seat 35. The first connector 21 of the connecting module 2 protrudes from the side of the socket body 1 for plugging to electronic devices. In the present embodiment, the thickness of the top portion of the socket body 1 is increased to form a bearing portion 16 for stably bearing an electronic device.

Fourth Embodiment

Figure 6:
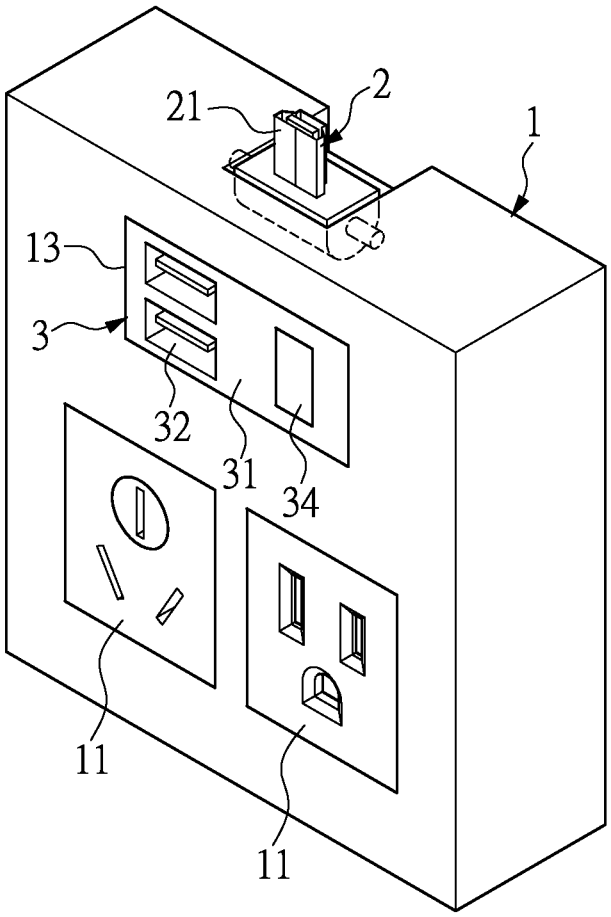
FIG. 6 shows a perspective view of a wall socket according to a fourth embodiment of the present disclosure.

Referring to FIG. 6, in the present embodiment, the connecting module 2 can be pivoted on the socket body 1, the connecting module 2 has a first connector, and the first connector 21 of the connecting module 2 can be electrically connected to the socket body 1 and the replaceable module 3 through cables, plates or connectors. The connecting module 2 can rotate, such that the connecting module 2 can stand upright or lay down on the socket body 1. When the connecting module 2 is upright on the socket body 1, the first connector 21 protrudes from a side of the socket body for plugging to an electronic device (e.g. cell phone).

Fifth Embodiment

Figure 7:
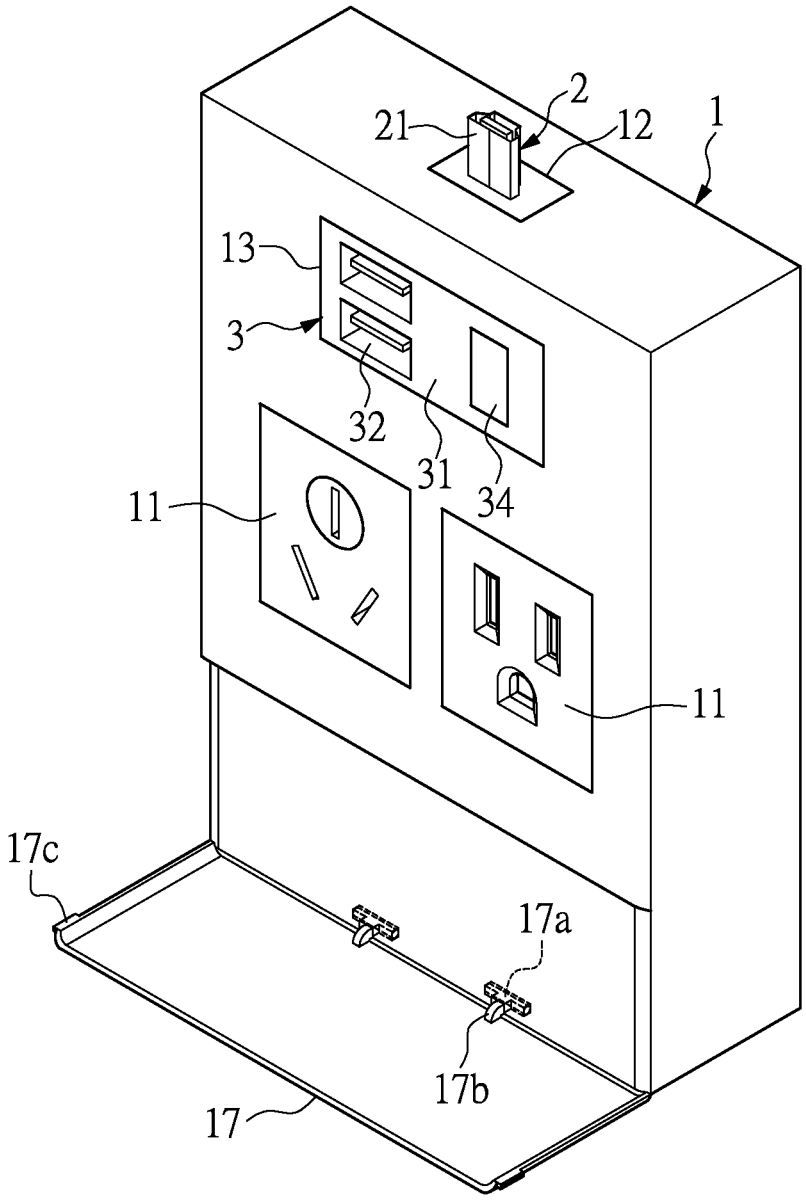
FIG. 7 shows a perspective view of a wall socket according to a five embodiment of the present disclosure.

Referring to FIG. 7, in the present embodiment, a bearing board 17 can be pivoted about the socket body 1. Namely, the socket body 1 has a first pivot portion 17*a*, a side of the bearing board 17 has a second pivot portion 17*b*, the first pivot portion 17*a* and the second pivot portion 17*b* can be a pivot hole and a corresponding pivot shaft, and the first pivot portion 17*a* and the second pivot portion 17*b* are pivotally connected such that the bearing board 17 is rotatably connected to the socket body. The structure connecting the bearing board 17 to the socket body 1 is not limited thereto, and can be different types of shaft, hinge, or pivot structures. The bearing board 17 can be turned downward into a horizontal (or slanted) position for accommodating electronic devices. When not in use, the bearing board 17 can be turned upward to be stacked on the front face of the socket body 1. The bearing board 17 can also have a snap portion 17*c* for snapping onto the socket body 1 when the bearing board 17 is turned upward.

Sixth Embodiment

Figure 8:
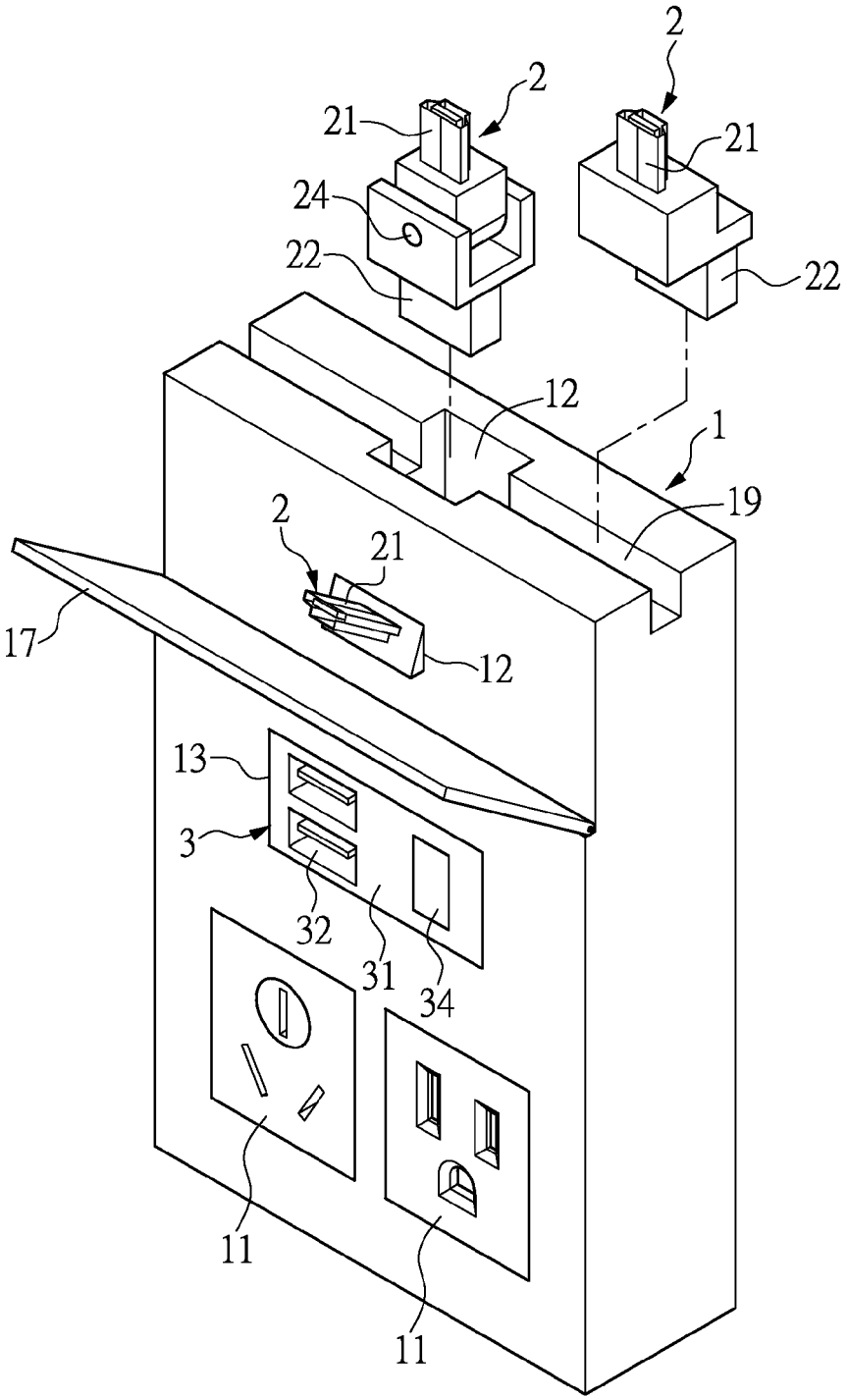
FIG. 8 shows a perspective view of a wall socket according to a sixth embodiment of the present disclosure.

Referring to FIG. 8, in the present embodiment, a bearing board 17 is pivoted about the socket body 1. The bearing board 17 can be turned downward to a slanted position for bearing electronic devices. The bearing board 17 can also be turned upward to be stacked on the front face of the socket body 1. The connecting module 2 is disposed on the socket body 1. The connecting module 2 can be electrically connected to the socket body 1. In the present embodiment, multiple connecting modules 2 are plugged to the socket body 1. Specifically, the front face and the top portion of the socket body 1 each have a docking slot 12. Each of the connecting modules 2 has a first connector 21 and a second connector 22. The first connector 21 and the second connector 22 are electrically connected. The connecting modules 2 can be plugged into the respective docking slots 12, such that the connecting modules 2 are fixed to the socket body 1. Each of the connecting modules 2 can be electrically connected by the respective second connector 22 to the respective connector (omitted in the figure) of the socket body 1. The first connectors 21 of the connecting modules 2 can protrude from the front face and the top portion of the socket body 1, for plugging to electronic devices. The connecting modules 2 are selectively plugged into the docking slots 12, and can be retrieved when not in use so that the bearing board 17 can be stacked on the front face of the socket body 1.

In the present embodiment, a storage slot 19 is formed on the top portion of the socket body 1 at two sides of the docking slot 12. When the connecting module 2 is not in use and retrieved from the docking slot 12, the connecting module 2 can be stored in the storage slot 19. Additionally, a shaft 24 can be disposed between the first connector 21 and the second connector 22 of some connecting modules 2. The first connector 21 and the second connector 22 are pivotally connected by the shaft 24, such that the connecting module 2 is foldable. When the connecting module 2 is not in use, the first connector 21 can be folded left or right and stored in the storage slot 19 for saving space.

Seventh Embodiment

Figure 9:
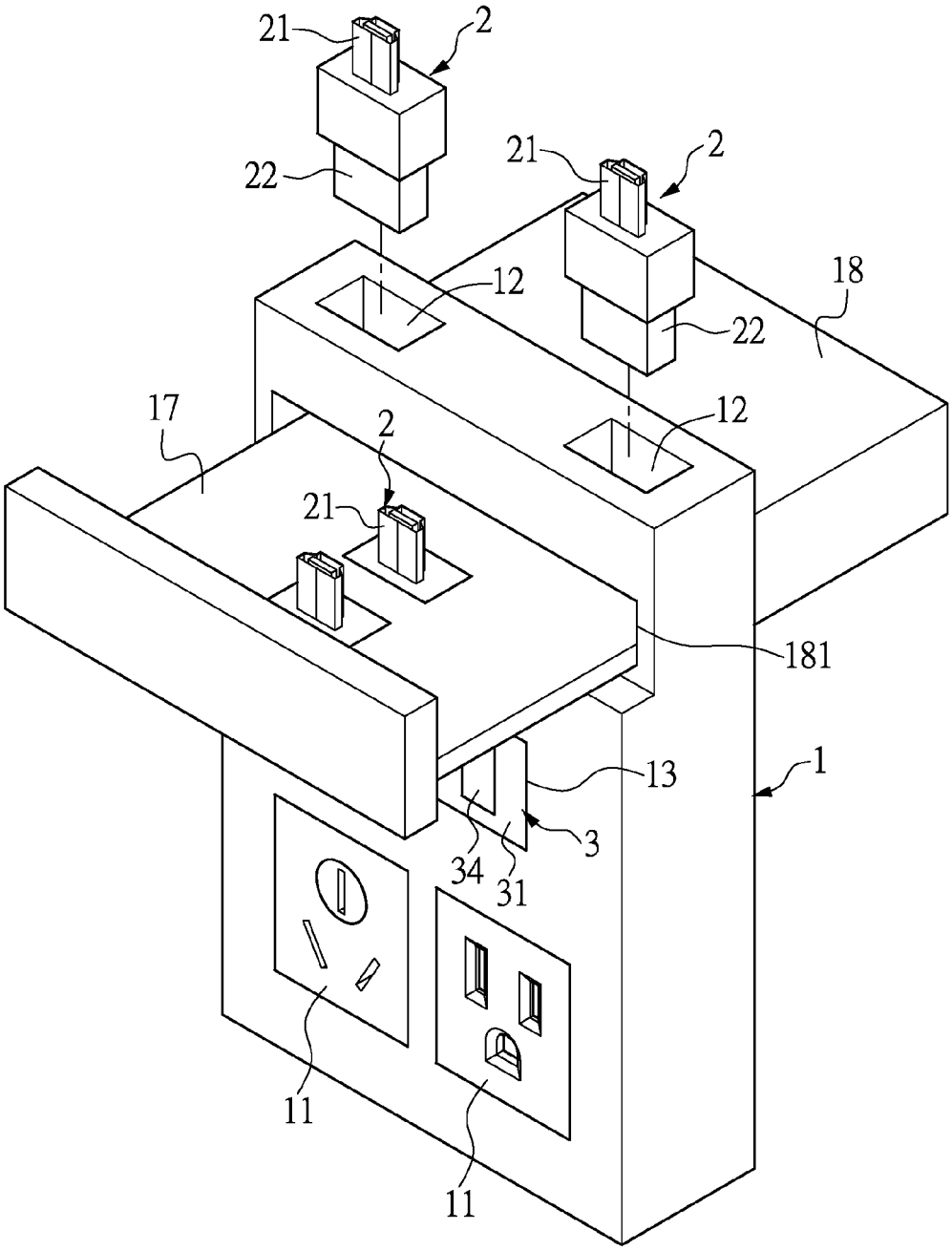
FIG. 9 shows a perspective view of a wall socket according to a seventh embodiment of the present disclosure.

Referring to FIG. 9, in the present embodiment, the socket body 1 has an accommodating box 18. The front end of the accommodating box 18 is formed with an opening 181. A bearing board 17 is slidably disposed in the accommodating box 18. The bearing board 17 can selectively extend out of the opening 181 of the accommodating box 18. Namely, when the bearing board 17 slides toward the front, the bearing board 17 extends out of the opening 181 of the accommodating box for bearing electronic devices. In the present embodiment, multiple connecting modules 2 are disposed, by plugging or pivotal connection, on the socket body 1 and the bearing board 17. The connection modules 2 can be electrically connected to the socket body 1 and the replaceable module 3. The connecting modules 2 selectively protrude from the top portions of the socket body 1 and the bearing board 17 for plugging to electronic devices. In the present embodiment, the connecting modules 2 are plugged to the socket body 1 and the bearing board 17, and can be retrieved when not in use. The connecting modules 2 can also be pivotally connected to the bearing board 17 and laid down when not in use.

Eighth and Ninth Embodiment

Figure 10:
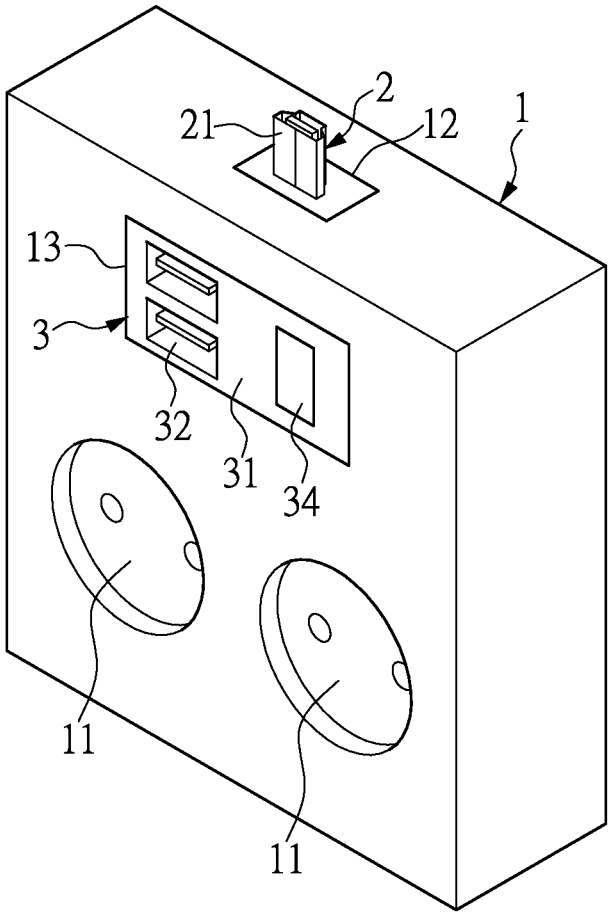
FIG. 10 shows a perspective view of a wall socket according to an eighth embodiment of the present disclosure.
Figure 11:
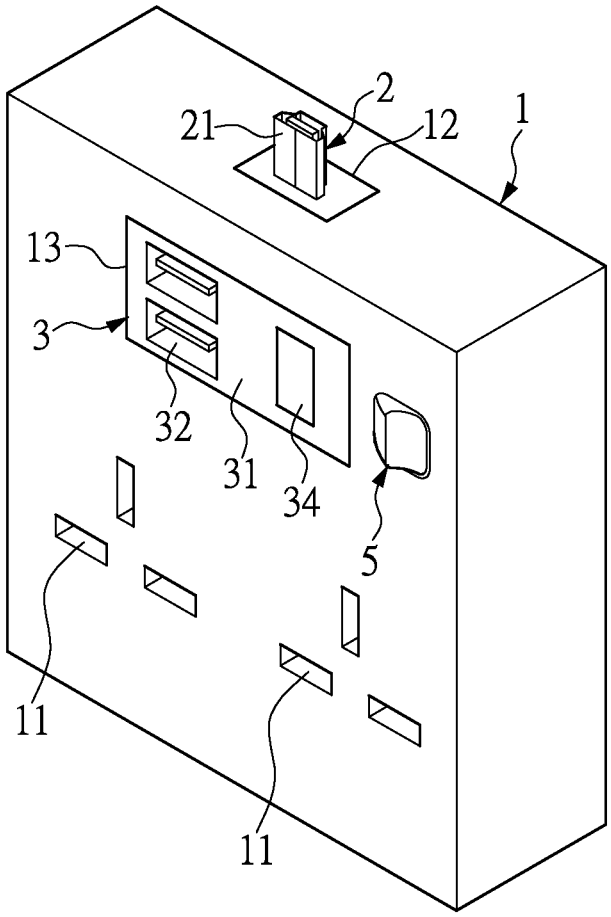
FIG. 11 shows a perspective view of a wall socket (wall switch) according to a ninth embodiment of the present disclosure.

Referring to FIG. 10, in the present embodiment, the socket unit 11 is of German standard. Referring to FIG. 11, in the present embodiment, the socket unit 11 is of British standard (UK). Additionally, a switch unit 5 can be disposed on the socket body 1. The switch unit is electrically connected to the circuit of the socket body 1 for controlling the on-off status of the socket body 1.

Tenth Embodiment

Figure 12:
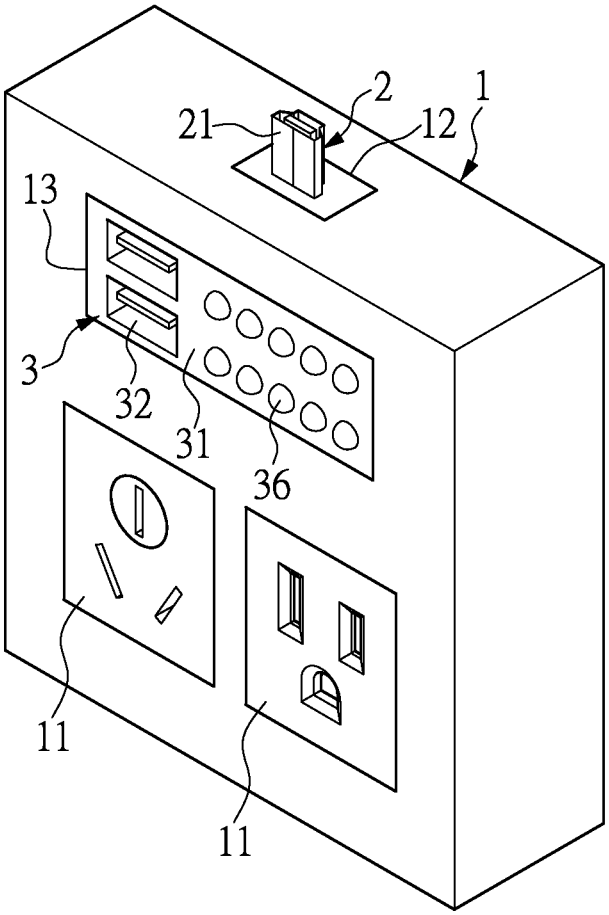
FIG. 12 shows a perspective view of a wall socket according to a tenth embodiment of the present disclosure.

Referring to FIG. 12, in the present embodiment, the replaceable module 3 has a display device 36. The display device 36 can be a plurality of light-emitting diodes or a liquid crystal display. The display device 36 of the present embodiment is a plurality of light-emitting diodes electrically connected to the replaceable module 3, e.g. the display device 36 can be electrically connected to the connector unit 32. When an electrical device is electrically connected to the connector unit 32, the display device 36 can display the current flowing to the electronic device. For example, a greater amount of lit light-emitting diodes indicate a greater current being transmitted. In addition to current, the display device 36 can also be used to show voltage.

Eleventh Embodiment

Figure 13:
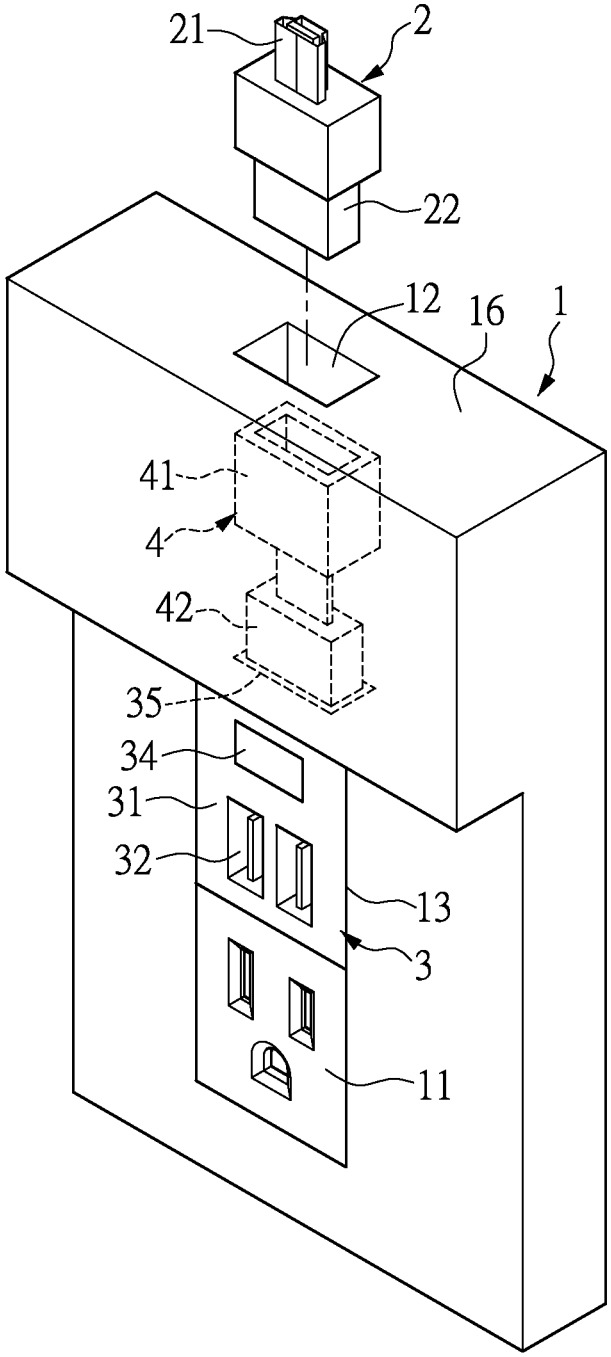
FIG. 13 shows a perspective view of a wall socket according to an eleventh embodiment of the present disclosure.

Referring to FIG. 13, in the present embodiment, an adapter 4 is disposed in the socket body 1. The adapter 4 has a third connector 41 and a fourth connector 42. The third connector 41 and the fourth connector 42 are electrically connected. The fourth connector 42 is plugged to the connecting seat 35. The connecting module 2 can be plugged to the docking slot 12 and the second connector 22 can be plugged into and be electrically connected to the third connector 41, such that the connecting module is electrically connected to the replaceable module 3 through the second connector, the adapter, and the connecting base 35.

The wall socket shown in FIG. 11 can also be considered as a wall switch. Namely, the present disclosure further provides a wall switch having a connecting module. The socket body 1 shown in FIG. 11 is also a switch body. The switch body has a switch unit 5. However, the shape and structure of the switch body is not limited. The connecting module 2 is disposed on the switch body. The connecting module 2 is electrically connected to the switch body. Namely, the connecting module 2 can be electrically connected to the circuit in the switch body. The connecting module 2 selectively protrudes from the switch body.

Additionally, the amount and specification of the switch unit 5 is not limited. One, two or more switch units 5 can be arranged according to need. The switch unit 5 can be disposed on the socket bodies 1 (switch bodies) of the above embodiments, or on switch bodies of other shapes and structures, to form a wall switch having a connecting module. Additionally, an accommodating slot can be formed on the switch body for removably accommodating the replaceable module 3. The replaceable module and the switch body are electrically connected. Since the switch body, the connecting module, and the replaceable module of the present embodiment are disclosed in the above embodiments detailing the socket body 1, the connecting module 2 and the replaceable module 3, they are not further detailed herein.

Twelfth and Thirteen Embodiment

Figure 14:
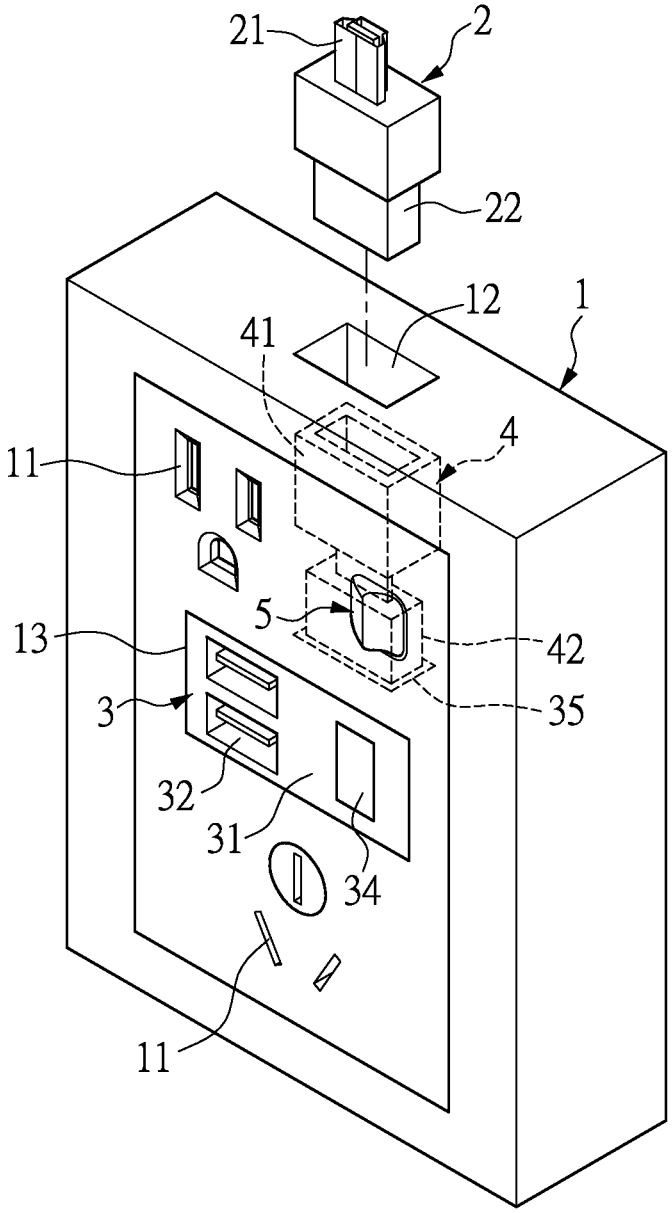
FIG. 14 shows a perspective view of a wall socket according to a twelfth embodiment of the present disclosure.
Figure 15:
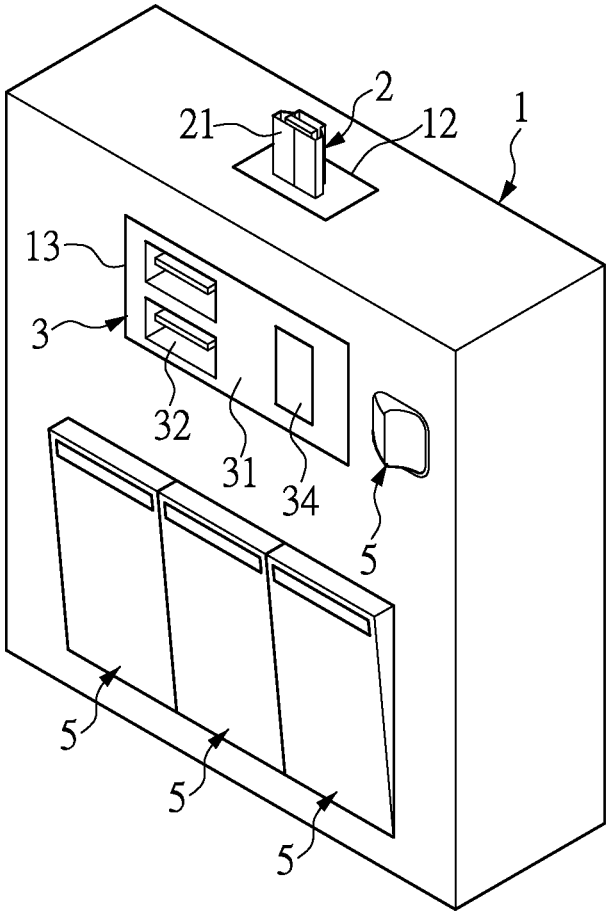
FIG. 15 shows a perspective view of a wall socket according to a thirteenth embodiment of the present disclosure.

Referring to FIG. 14 and FIG. 15, the wall sockets of the present embodiments can also be considered as wall switches. The socket body 1 is also a switch body. The switch body can have one, two or more switch units 5. The connecting module 2 is disposed on the switch body and electrically connected to the switch body. The switch body has an accommodating slot 13 for removably accommodating the replaceable module 3. The replaceable module 3 is electrically connected to the switch body.

Fourteenth Embodiment

Figure 16:
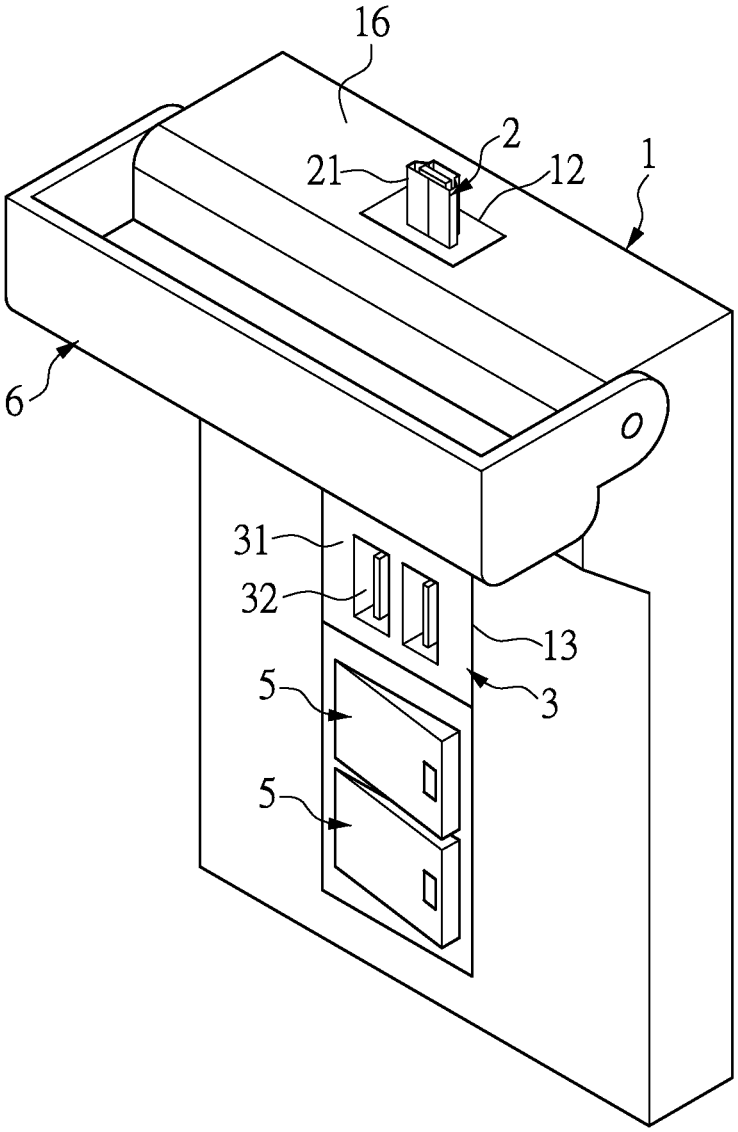
FIG. 16 shows a perspective view of a wall socket according to a fourteenth embodiment of the present disclosure.

Referring to FIG. 16, a cover 6 is pivoted about the socket body 1 (switch body). When the connecting module 2 is not in use, the cover 6 can selectively cover the connecting module for protecting the connecting module. When the cover 6 is opened, the cover 6 can also store connecting modules 2 not in use.

Fifteenth Embodiment

Figure 17:
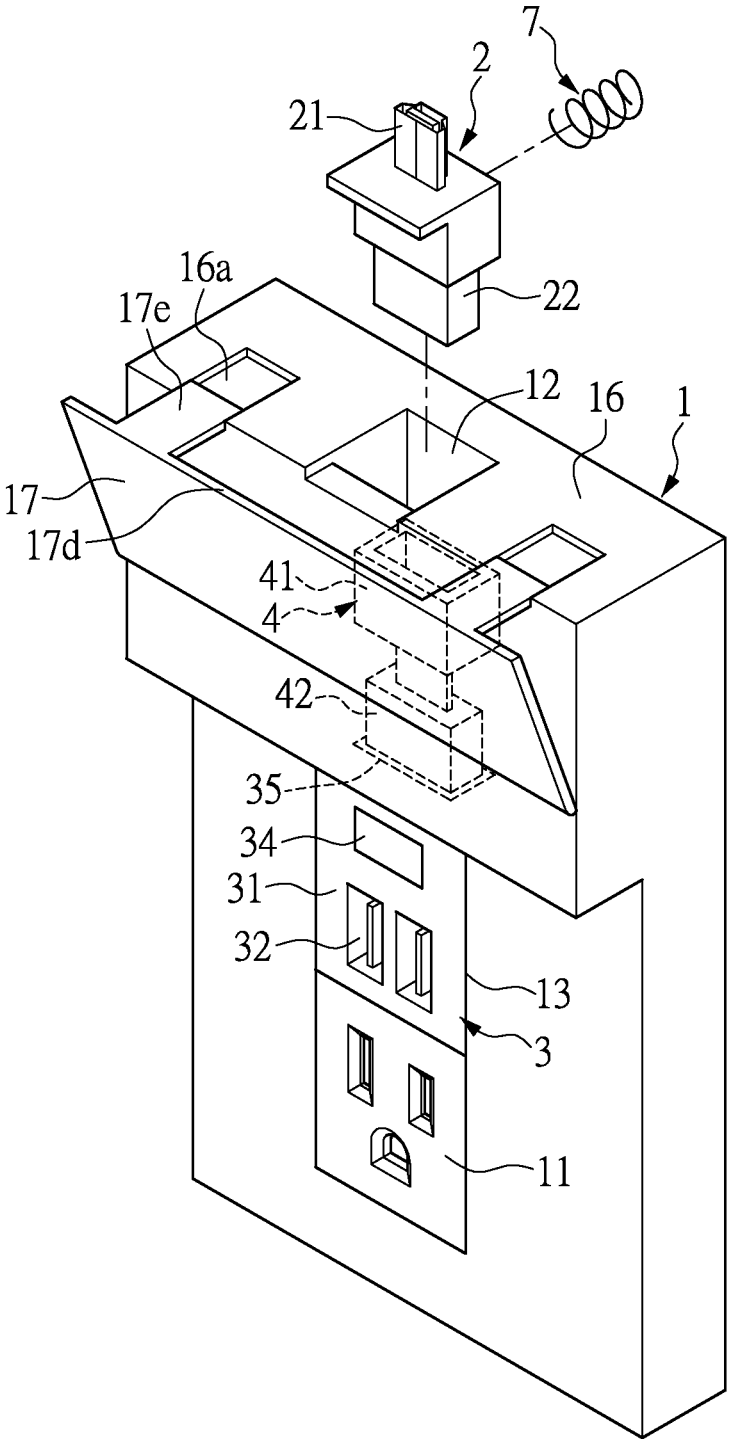
FIG. 17 shows a perspective view of a wall socket according to a fifteenth embodiment of the present disclosure.

Referring to FIG. 17, a bearing board 17 is pivoted about the socket body 1. The bearing board 17 can be turned down to a slanted position for using an end portion 17*d* of the bearing board 17 to assist the bearing portion 16 of the top portion of the socket body 1 in bearing electronic devices. The end portion 17*d* of the bearing board 17 increases the area for bearing electronic devices such that electronic devices can be more stably placed. The bearing board 17 can be turned up when not in use to be stacked on the front face of the socket body. The end portion 17*d* of the bearing board 17 has sliding rails 17*e*, and the top portion of the socket body 1 has corresponding sliding grooves 16*a*. The sliding rails 17*e* slide in the sliding grooves 16*a* for stabilizing the bearing board 17 during turning. Additionally, the sliding rails 17*e* can provided surface for placing electronic devices.

The connecting module 2 is movably disposed on the socket body 1. Namely, the connecting module 2 is slidably disposed in the docking slot 12. The third connector 41 and the fourth connector 42 are electrically connected by a flexible cable therebetween, such that the third connector 41 can move along with the connecting module 2. An elastic unit 7 is disposed between the connecting module 2 and the socket body 1. The elastic unit 7 can abut the connecting module 2 to move toward the front. When the connecting module 2 moves forward to a predetermined position, the connecting module 2 can abut the front end of the docking slot 12, or another positioning structure arranged at the proper position. The moving forward of the connecting module 2 facilitates the plugging of an electronic device to the first connector 21 of the connecting module 21, avoiding interference by the wall. When the bearing board 17 is not in use and stacked on the front face of the socket body 1, the bearing board 17 can abut the connecting module 2 to move toward the back to the original position.

The wall socket of the present disclosure includes a socket body and a connecting module, serving as a socket, adapter and connector, providing a more universal function and varied application, and also reducing the need of the buyer to purchase adapters. Moreover, when the connecting module is disposed at the top portion of the socket body, electronic devices can be place on top of the socket body such that the socket body also has a bearing function, so that electronic devices can be stably placed when being charged, connected to the power supply or connected to the internet. The present disclosure can also have a bearing board for bearing electronic devices.

The wall switch of the present disclosure serves as a switch, adapter and connector. Additionally, electronic devices can also be place on top of the switch body such that the wall body also has a bearing function.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A wall socket having a connecting module, comprising:

a socket body having a socket unit; and a connecting module disposed on and electrically connected to the socket body, wherein the connecting module selectively protrudes from the socket body;

wherein a bearing board is pivotally connected to the socket body, the bearing board is turned downward to a slanted position or upward to be stacked on the front face of the socket body, an end portion of the bearing board is connected to sliding rails, the top portion of the socket body has sliding grooves, the sliding rails slidably engage the sliding grooves, the connecting module is disposed on the socket body and move forward and backward, an elastic unit is disposed between the connecting module and the socket body for abutting the connecting module to move forward, and when the bearing board is tacked on the front face of the socket body, the bearing board abuts the connecting body to move backward.

2. The wall socket having a connecting module according to claim 1, wherein the connecting module is plugged to the socket body.

3. The wall socket having a connecting module according to claim 2, wherein the socket body has a docking slot positioned at the top portion, the front side, the left side or the right side of the socket body, the connecting module has a first connector and a second connector, the first connector and the second connector are electrically connected, the connecting module is plugged to the docking slot, and the first connector protrudes from the socket body.

4. The wall socket having a connecting module according to claim 3, wherein the socket body has an accommodating slot for removably accommodating a replaceable module, the replaceable module has a module body and a connector unit disposed on the module body, and the replaceable module and the socket body are electrically connected.

5. The wall socket having a connecting module according to claim 4, wherein the module body has an electronic apparatus.

6. The wall socket having a connecting module according to claim 4, wherein the edge of the replaceable module has a connecting seat corresponding to the docking slot, and the second connector of the connecting module is plugged to the connecting seat.

7. The wall socket having a connecting module according to claim 4, wherein the socket body has an adapter therein, and the connecting module is electrically connected to the replaceable module through the adapter.

8. The wall socket having a connecting module according to claim 1, wherein the socket body has an accommodating slot, the accommodating slot removably accommodates a replaceable module, the replaceable module has a module body and a connector unit disposed on the module body, and the replaceable module and the socket body are electrically connected.

9. The wall socket having a connecting module according to claim 1, wherein the top portion of the socket body is formed with a bearing portion.

10. The wall socket having a connecting module according to claim 1, wherein a bearing board is pivotally connected to the socket body, the bearing board can be turned downward to a horizontal or slanted position, or be turned upward to be stacked on the front face of the socket body.

11. A wall switch having a connecting module, comprising:

a switch body having a switch unit; and a connecting module disposed on and electrically connected to the switch body, wherein the connecting module selectively protrudes from the switch body;

wherein a bearing board is pivotally connected to the wall body, the bearing board is turned downward to a slanted position or upward to be stacked on the front face of the wall body, an end portion of the bearing board is connected to sliding rails, the top portion of the wall body has sliding grooves, the sliding rails slidably engage the sliding grooves, the connecting module is disposed on the wall body and move forward and backward, an elastic unit is disposed between the connecting module and the wall body for abutting the connecting module to move forward, and when the bearing board is tacked on the front face of the wall body, the bearing board abuts the connecting body to move backward.

12. The wall switch having a connecting module according to claim 11, wherein the socket switch has an accommodating slot for removably accommodating a replaceable module, the replaceable module has a module body and a connector unit disposed on the module body, and the replaceable module and the socket body are electrically connected.

13. The wall switch having a connecting module according to claim 11, wherein the top portion of the switch body is formed with a bearing portion.

14. The wall switch having a connecting module according to claim 11, wherein a bearing board is pivotally connected to the switch body, the bearing board can be turned downward to a horizontal or slanted position, or be turned upward to be stacked on the front face of the switch body.

* * * * *